United States Patent [19]

Basore

[11] Patent Number: 4,828,123

[45] Date of Patent: May 9, 1989

[54] CLOTHES DRYING RACK

[75] Inventor: Charles W. Basore, Cordova, Tenn.

[73] Assignee: Lear Siegler Seymour Corp., Seymour, Ind.

[21] Appl. No.: 109,629

[22] Filed: Oct. 19, 1987

[51] Int. Cl.[4] ..... A47F 5/00

[52] U.S. Cl. ..... 211/202; 248/176

[58] Field of Search ..... 211/202, 195, 105; 248/127, 163.1, 163, 164, 166, 176; 403/153, 197, 219, 248

[56] References Cited

U.S. PATENT DOCUMENTS

| | | | |
|---|---|---|---|
| Re. 16,324 | 4/1926 | Schmitt | 211/202 |
| 127,881 | 6/1872 | Hill | 211/202 |
| 1,594,415 | 8/1926 | Kalgren | 211/202 |
| 2,388,637 | 11/1945 | John | 211/202 X |
| 3,133,645 | 5/1964 | Cecil | 211/202 |
| 3,789,996 | 2/1974 | Stroh | 211/119 |
| 4,131,205 | 12/1978 | Malecki | 211/202 X |
| 4,297,795 | 11/1981 | Licari | 211/202 X |

*Primary Examiner*—Robert W. Gibson, Jr.

*Attorney, Agent, or Firm*—Clement and Ryan

[57] ABSTRACT

A collapsible clothes drying rack that operates on the "lazy tong" principle has four extended upper amrs supporting two opposed, parallel rods that are spaced apart approximately twice as far as the two upper, outside rods are spaced in a conventional collapsible clothes dryer. A mesh support member is provided with means at opposite ends thereof for attaching the mesh member to the parallel, spaced apart rods at the top of the four extended arms of the collapsible clothes drying rack, for use, among other things, in the drying of seaters. The collapsible rack includes a pair of foldable and extendable lazy tong linkages with a plurality of clothes supporting rods extending between and pivotally secured to the lazy tong linkages. Wooden clothes supporting rods sheathed in plastic are secured to the folding arms of the lazy tong linkages. In a preferred embodiment, a rigid ferrule is seated within a receiving hole in each lazy tong arm to form a tight fit with the rod, and a tapered threaded member is screwed into the end of the wooden rod that is seated in the rigid ferrule.

7 Claims, 1 Drawing Sheet

10
12
14
16
16a
16b
16c
18
18a
18b
18c
20
20a
20b
20c
22
24
26
28
30
32
34
36
38
40
42
44
46
48
50
52
54
56
58
60
62
64
66
68
70
2
3
4

CLOTHES DRYING RACK

This invention relates to a collapsible clothes drying rack, and in particular such a rack having a sweater drying capability.

BACKGROUND OF THE INVENTION

Collapsible clothes drying racks have been known for well over a century, at least since U.S. Pat. No. 82,280 was issued to J. B. Blood on Sept. 22, 1868. As that patent was issued for an "Improved Clothes-Drier" of a complicated construction and specifically described dimensions, simpler and more conventionally designed collapsible clothes drying racks were presumably in use even earlier than 1868.

In the few cases known to applicant in which conventional collapsible clothes drying racks of "lazy tong" construction have been provided with extenders at their upper extremities, this has involved a complicated and relatively expensive arrangement of parts, such as in Cecil U.S. Pat. No. 3,133,645, issued May 19, 1964, and German Pat. No. 2,719,771 dated Nov. 24, 1977.

In some cases, such as the German patent just cited and Schissel U.S. Pat. No. 2,406,638 issued Aug. 27, 1946, flexible, spaced, parallel means have been provided to support the clothing being dried, which support means could perhaps be used to support a wet or damp sweater. However, if this was done, the sweater would dry in a distorted shape, and furthermore any such use would preempt all the hanging positions for other clothes to be dried.

It has long been known that the pivoted connections in the conventional lazy tong construction of a clothes drying rack tend to become loose with the passage of time, and with continued opening and closing of the collapsible racks. In fact, an almost universal complaint about conventional collapsible clothes drying racks that operate on the "lazy tong" principle is that as the pivoted connections become loose with extended use of the rack, the rack in its erected condition becomes so unstable that it often falls over, and the clothes being dried fall to the floor.

Fastening devices that would make it possible to adjust the pivoted joints of a collapsible clothes drying rack, to correct for this loosening that has occurred over time, have been used in such applications as disclosed in U.S. Pat. No. 521,861 issued to Zeiser et al. on June 26, 1894, almost a century ago. Similar devices have been used over the years in other applications, such as shown in German Pat. No. 2,420,264 dated Nov. 6, 1975. However, until applicant made the present invention, it has apparently not been thought possible to remedy the problem in question in collapsible clothes drying racks by utilizing such fastening means that have been available for a very long time in other fields.

SUMMARY OF THE INVENTION

The collapsible clothes drying rack of the present invention solves all the problems just discussed that have been presented by prior art racks.

The rack of this invention is comprised of a pair of foldable and extendable lazy tong linkages having lower and upper terminal ends. Each lazy tong linkage includes a series of "X"-shaped subassemblies (typically, three such subassemblies) pivotally attached to each other, with the uppermost "X"-shaped subassembly of each series having arms of greater length than the arms of the subassemblies below that uppermost subassembly.

A plurality of rods extends between the two lazy tong linkages, with the rods being pivotally secured to each lazy tong linkage. In addition, a pair of opposed, parallel, spaced apart clothes supporting rods extends between the upper extremities of the longer arms of the uppermost "X"-shaped subassemblies. The longer arms are preferably of such a size that the distance between the last mentioned pair of clothes supporting rods is approximately twice the distance between the upper extremities of the arms of the "X"-shaped subassemblies below the uppermost subassembly, and therefore is approximately twice that distance in a conventional collapsible clothes dryer that operates on the "lazy tong" principle.

The rack includes means for releasably locking the lazy tong linkages in their extended positions, so that the rack can be set up for drying clothes and taken down when the drying is completed.

An important feature of the preferred clothes drying rack of this invention is a mesh support member extending between the pair of opposed, parallel, spaced apart clothes supporting rods at the upper extremities of the longer arms of the uppermost "X"-shaped subassemblies. Opposite ends of this mesh support member carry means for attaching the same to the two spaced-apart clothes supporting rods referred to. The mesh support member is especially adapted, as will be explained below, for use in drying a wet or damp sweater without stretching or otherwise distorting the sweater and without interfering with the hanging of other clothes to be dried on other clothes supporting rods of the rack.

In the preferred construction of the clothes drying rack of this invention, each arm of the foldable lazy tong subassembly defines a receiving hole at the point of attachment of one of the clothes supporting rods. This attachment includes a rigid ferrule seated within the receiving hole to form a tight fit with the clothes supporting rod. The end portion of the rod is in turn seated within the ferrule to form a tight fit. Finally, a threaded member, which is tapered to its smallest dimension at its free end, is screwed into the end portion of the clothes supporting rod seated within the metal ferrule.

The ferrule is seated in and extends through aligned holes in each pair of lazy tong subassembly arms that are pivotally attached to each other. In turn, the end portion of the clothes supporting rod that is secured to these pivotally attached subassembly arms is tightly seated in and extends through the ferrule.

BRIEF DESCRIPTION OF THE DRAWING

The invention will now be described in more detail by reference to the accompanying drawing, in which.

DETAILED DESCRIPTION OF ONE EMBODIMENT OF THE INVENTION

Figures 1, 2, 3, 4:
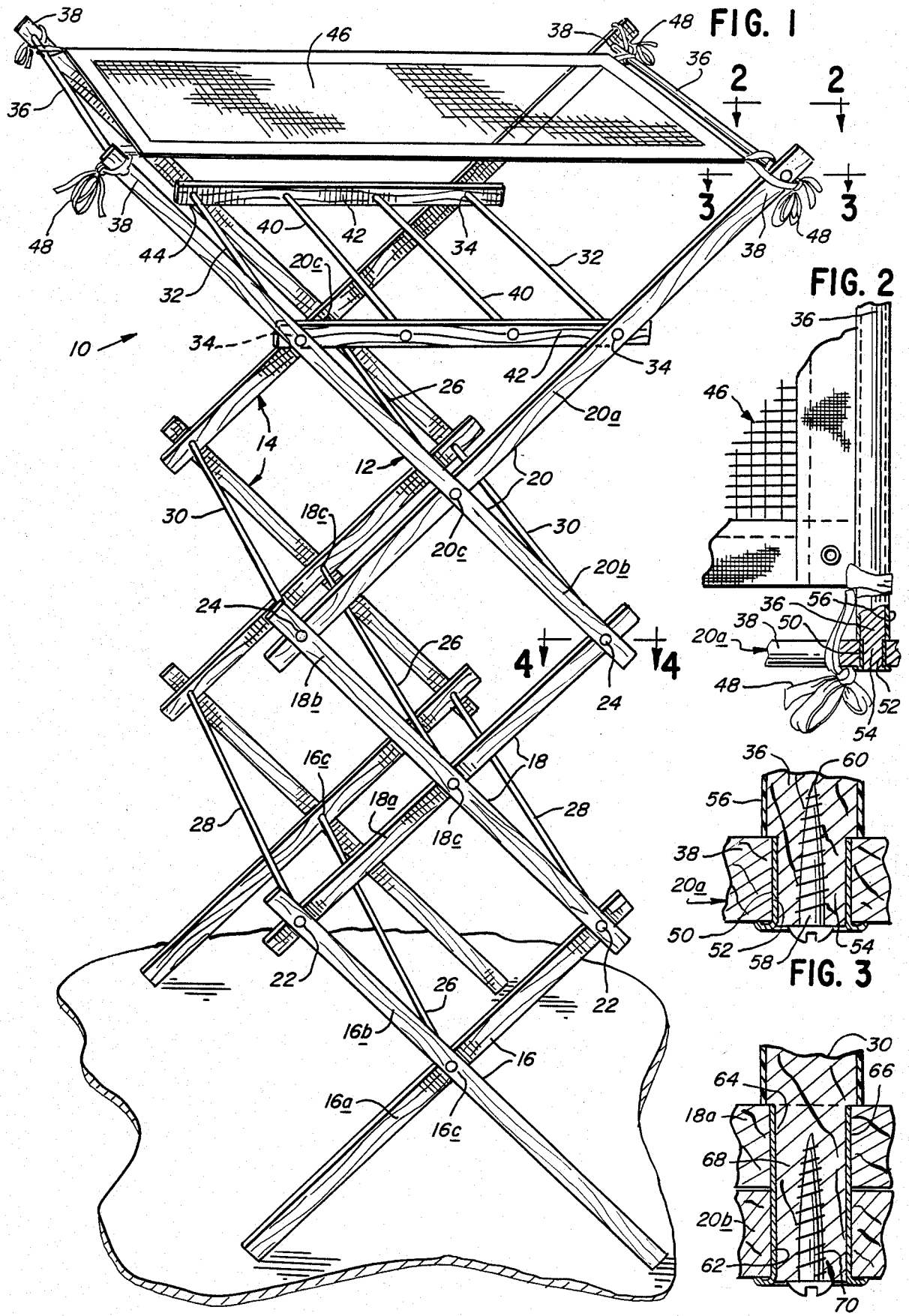
FIG. 1 is a perspective view of the clothes drying rack of this invention in its erected condition.
FIG. 2 is an enlarged, fragmentary plan view, partly in section, of one corner of the mesh screen that is included at portion 2—2 of the upper extremity of the clothes drying rack of FIG. 1, showing a means of attachment of the mesh screen to a clothes supporting rod of the rack.
FIG. 3 is a fragmentary sectional view, taken along line 3—3 in FIG. 1, showing the mode of attachment of the end portion of a clothes supporting rod to the upper extremity of the uppermost lazy tong subassembly of clothes drying rack of FIG. 1.
FIG. 4 is a similar view, taken along line 4—4 in FIG. 1, showing the mode of attachment of the end portion of a clothes supporting rod to two pivotally connected arms of adjacent lazy tong subassemblies.

The collapsible clothes drying rack of this invention is shown in its erected condition in FIG. 1, with a number of rods in position to support various wet or damp articles of clothing, and a mesh screen at the upper extremities of the rack that is especially adapted for supporting a wet or damp sweater during drying. The rack may be constructed from any suitable hard wood, with the clothes supporting parts of the rods just mentioned preferably being sheathed in plastic.

Lazy Tong Structure

Collapsible clothes drying rack 10 includes a pair of foldable and extendable lazy tong linkages 12 and 14. Lazy tong linkage 14 on the far side of FIG. 1 is the mirror image of lazy tong linkage 12 on the near side of that Figure.

Lazy tong linkage 12 includes series of "X"-shaped subassemblies 16, 18 and 20. Subassembly 16 is comprised of arms **16*a* and 16*b*, which are pivotally attached to each other at pivot point 16*c* located at their respective midsections. Subassembly 18 is similarly formed of arms 18*a* and 18*b*, which are pivoted at point 18*c***.

Subassembly 20 is generally similar to subassemblies 16 and 18, but, as will be explained below, is different in one essential respect.

Each subassembly 16, 18 and 20 is pivotally attached at at least one of its extremities to a vertically adjacent similar subassembly, as at pivot points 22 and 24.

Longer Upper Arms

Uppermost "X"-shaped subassembly 20 has arms **20*a* and 20*b* of greater length than arms 16*a*/16*b* and arms 18*a*/18*b* of the two lower subassemblies 16 and 18, respectively. Arms 20*a* and 20*b* are pivotally attached to each other at the lower portions of their respective midsections, rather than at the approximate midpoint of the arms as is the case with subassemblies 16 and 18**.

It will be seen that one advantage of longer arms 20 is that they make it possible to include two additional clothes supporting rods in the rack without increasing the floor area occupied by the rack. Another important advantage is that the longer arms make it possible for the rack to include the mesh support member to be described below.

Clothes Supporting Rods

As shown in FIG. 1, rods 26 extend between and are secured to the midsections of each lazy tong subassembly 16, 18 and 20. Rods 28 and 30 extend between and are secured to lazy tong linkages 12 and 14 at pivot points 22 and 24, respectively, which are located in the outer portions of subassemblies 16, 18 and 20. Rods 32 extend between and are secured to lazy tong linkages 12 and 14 at attachment points 34 in arms **20*a* and 20*b* of uppermost subassembly 20** in each of the lazy tong linkages.

Rods 36 extend between upper extremities 38 of longer arms **20*a* of uppermost "X"-shaped subassembly 20 of lazy tong linkages 12 and 14. Finally, in this embodiment, clothes supporting rods 40 extend between locking means 42 (to be discussed below) carried by lazy tong linkages 12 and 14**.

Rods 26, 28, 30, 32 and 36 are all secured to at least one of the arms in subassemblies 16, 18 and 20 of lazy tong linkages 12 and 14. The end portions of rods 26 in typical embodiments of the clothes drying rack of this invention are fixedly secured to the outer arm of the respective lazy tong linkages at pivots **16*c*, 18*c* and 20*c*, and are pivotally secured to the inner arm of the respective lazy tong linkage. At some point in time, depending upon the kind and extent of wear in the rod end portions, the rods in the typical embodiments of racks just referred to may be pivotally secured to the outer arm of the lazy tong linkage and fixedly secured to the inner arm. In other embodiments, this may be true at all times. The same relationship obtains with clothes supporting rods 28 and 30, and with rod 32 on the right-hand side of FIG. 1**.

In every case, in order to achieve the desired stability of the rack when it is in its erected condition, the tolerances in the production of the clothes supporting rods described and the lazy tong subassembly arms to which they are attached should preferably be maintained sufficiently tight that the lazy tong members will extend and retract stiffly rather than loosely.

All the rods that have been described serve to support wet or damp articles of clothing that are to be dried on rack 10. Rods 36 and 40 function as clothes supporting rods that are at all times fixedly, not pivotally, attached to upper extremities 38 of arms **20*a* and 20*b*, and to locking means 42**, respectively.

As will be seen, in the embodiment illustrated in FIG. 1, the distance between clothes supporting rods 36 is approximately twice the distance between each pair of clothes supporting rods 28 and 30 at the upper extremities of the arms of "X"-shaped subassemblies 16 and 18 that are located below uppermost subassembly 20. This spacing makes it possible to utilize a mesh support member (as described below) of a much larger overall area than would be possible if the mesh support member were suspended from a conventional collapsible clothes drying rack. When the mesh support member is used, rods 36 are not ordinarily used as direct clothes supporting members.

Locking Means

Arms 42 serve as means for releasably locking foldable lazy tong linkages 12 and 14 in their extended positions. Each locking arm 42 is pivoted at one end (for example, on the right-hand side of FIG. 1) to the upper part of the midsection of longer arm **20*a* of the uppermost "X"-shaped subassembly 20, and to one of clothes supporting rods 32**.

The other end of each locking arm 42 (on the left-hand side of FIG. 1) defines notch 44 in its bottom edge, to selectively engage the other clothes supporting rod 32 extending from lazy tong linkage 12 to linkage 14. As will be seen in FIG. 1, when notch 44 of locking arm 42 engages clothes supporting rod 32 in the left-hand part of that Figure, foldable lazy tong linkages 12 and 14 are maintained in their extended positions. Then, when notch 44 is disengaged from clothes supporting rod 32, clothes drying rack 10 can be collapsed by folding lazy tong linkages 12 and 14 down to bring arms 16, 18 and 20 into closed position against each other.

As one skilled in the art will recognize, the preferred stiff operating characteristics of the connections between the clothes supporting rods and lazy tong subassembly arms that are discussed above are effective in helping to hold locking arms 42 in place engaged with rod 32, thereby helping to hold the rack in a stable erected position.

Mesh Support Member

Mesh support member 46 is shown in FIG. 1 extending between opposed, parallel, spaced apart clothes supporting rods 36 at the upper extremities 38 of longer arms 20 in the uppermost "X"-shaped subassembly of clothes drying rack 10. Cloth straps 48 are provided at each of the four corners of mesh member 46, for tying loops to secure member 46 to upper extremities 38 of arm 20*a*. This arrangement of parts is shown in expanded fragmentary view in FIG. 2.

Mesh support member 46 is preferably a flexible member, formed of any suitable plastic material. Satisfactory results may be obtained with mesh openings that are about 1" in width and about 1" in length. Improved results are obtained with openings that are about ½" in each direction. Best results are obtained with mesh openings that are about ⅛" and ¼" in width and length, respectively.

Mesh support member 46 may be used to support any articles of clothing being dried, but it is especially adapted to hold a wet or damp sweater, since spreading the sweater out on support member 46 will avoid the stretching or other distortion of the sweater that would inevitably occur if the sweater were hung from hooks, shower curtain rods, or the like, or even from one or more of the clothes supporting rods of this rack, to dry. At the same time, the drying will proceed much more rapidly and efficiently because both the top and bottom portions of the sweater will be effectively exposed to the surrounding atmosphere, as the sweater is spread out upon the mesh support member. The drying process will thus proceed more rapidly than if the wet or damp sweater were spread out upon a sheet of tissue paper, or other solid surface, for drying.

As will be seen, drying a sweater upon mesh support member 46 will in no way interfere with the drying of the other wet or damp articles that are positioned for drying on clothes supporting rods 26, 28, 30, 32 and 40. The mesh support member thus greatly improves the clothes drying capability of the rack, in terms of both the kind of clothes that can be dried, and the quantity of clothes that can be dried at any given time.

Rod Securing Means

As already stated, collapsible clothes drying racks making use of foldable and extendable lazy tong linkages have been known for much longer than a century. In all of these, as the lazy tong linkages such as linkages 12 and 14 of clothes drying rack 10 are opened and closed hundreds of times when the clothes drying rack is used over a long period of time, wear occurring in the pivots of the linkage will cause the rack structure to become loose and less stable.

Although means have long been available, during the century or more just referred to, to alleviate this problem, applicants do not know of any collapsible clothes drying rack in which the problem has been met. In the preferred embodiment of the clothes drying rack 10 of this invention, illustrated in the accompanying drawing, this wear problem is successfully met for pivots 16*c*, 22, 18*c*, 24 and 20*c*, and for pivot 34 on the right-hand side of FIG. 1. Because the indicated wear problem is satisfactorily dealt with in this preferred embodiment, the folding lazy tong linkages of this rack can be kept tight, so that the rack remains stable and reliably erect over an indefinite period of time.

As will be seen, because clothes supporting rods 26, 28 and 30 are all attached to lazy tong linkages 12 and 14 at points where the respective arms of subassemblies 16, 18 and 20 are pivotally connected, the end portion of each of these rods passes through two arms, such as, for example, arms 16*a* and 16*b*. The same is true of the end protions of one clothes supporting rod 32, i.e., the one on the right-hand side of FIG. 1. In each such case, the rod end portion preferably forms a tight fit with one of the lazy tong subassembly arms, and a snug but pivotable fit with the other arm.

On the other hand, the end portions of clothes supporting rods 36, as well as the end portions of rod 32 on the left-hand side of FIG. 1, are attached to only one lazy tong subassembly arm. The attaching means is nevertheless the same in all the cases referred to. Because the resulting structure for the attachment of the ends of rods 36 to portions 38 of arms 20 is simpler than the attachment of rods 26, 28 and 30 to their respective lazy tong subassembly arms, the attachment of rod 36 on the right-hand side of FIG. 1 will be described first.

As shown in FIG. 3, which provides an expanded, fragmentary sectional view taken along the line 3—3 in FIG. 1, upper extremity 38 of each arm 20*a* defines a receiving hole 52 at the fixed attachment of each end of clothes supporting rod 36. Rigid ferrule 50, suitably formed of metal or plastic, is seated within and extends through receiving hole 52. Ferrule 50 forms a tight, stationary fit with upper extremity 38 of arm 20*a*. End portion 54 of clothes supporting rod 36 is seated within and extends through ferrule 50 to form, in turn, a tight fit with the ferrule.

As already stated above, rod 36 (as well as the other clothes supporting rods of the rack) is typically formed of a suitable hard wood and, except for reduced end portion 54, is sheathed by a suitable plastic 56. Threaded member 58 tapers to a minimum dimension at its free end 60. As seen, it is screwed into end portion 54 of clothes supporting rod 36, to cause end portion 54 to press more firmly against ferrule 52 whenever this is made necessary because of any loosening of the attachment over time.

If desired, the screws or other tapered threaded members may be inserted in all the connections between the clothes supporting rods and the lazy tong subassembly arms during the period of first use of the rack, or the threaded members may be inserted only as the need becomes apparent when wear occurs in the connections upon extended use of the rack. If necessary, a larger diameter threaded member 58 may be used as end portion 54 becomes worn still further, and the smaller diameter tapered member is no longer effective to produce a tight fit between the rod end portion and the ferrule in which it is seated.

This wear, as already mentioned, is most likely to occur—upon repeated opening and closing of lazy tong subassemblies 12 and 14—in the end portions of clothes supporting rods 26, 28 and 30, and to a certain extent the end portions of rod 32 on the right-hand side of FIG. 1, all of which, unlike rod 36, engage at least one lazy tong subassembly arm in a pivotal connection. As has been explained, the fit of the end portion of clothes supporting rods 26, 28 and 30 with their respective ferrules at pivot points 16*a*, 22, 18*c*, 24 and 20*c* is preferably snug but pivotable with respect to at least one of each pair of arms 16, 18 and 20. It is in such a pivotal connection that the greatest wear occurs.

FIG. 4 shows the same type of rod securing means for clothes supporting rod 30 at pivotal attachment point 24 between lazy tong subassembly arms 18*a* and 20*b*. The Figure is a fragmentary sectional view taken along line 4—4 in FIG. 1.

As in FIG. 3, arm 20*b* defines receiving hole 62, and arm 18*a* defines receiving hole 64. Ferrule 66 is seated in, and extends through, receiving holes 62 and 64, to form a tight fit with those holes. End portion 68 of clothes supporting rod 30 is seated in and extends through ferrule 66, to form a tight fit with the ferrule.

Tapered threaded member 70 is screwed into end portion 68, to cause the clothes supporting rod to press more firmly against ferrule 66 whenever this is made necessary because of loosening of the pivotal attachment over time.

The above detailed description has been given for ease of understanding only. No unnecessary limitations should be understood therefrom, as modifications will be obvious to persons skilled in the art.

I claim:

1. A collapsible clothes drying rack for drying various wet or damp articles of clothing which comprises:

(a) a pair of foldable and extendable lazy tong linkages, each of the lazy tong linkages of said pair including a series of "X"-shaped subassemblies comprised of two arms pivotally attached to each other at their respective midsections, each of said subassemblies being pivotally attached at at least one of its extremities to a vertically adjacent similar subassembly, with the uppermost "X"-shaped subassembly of each of said series having arms of greater length than the arms of the subassemblies below said uppermost subassembly;

(b) a plurality of rods extending between and secured to said lazy tong linkages, for maintaining the linkages in spaced parallel relationship to each other during extension and retraction from folded to extended position and return, and for supporting articles of clothing to be dried;

(c) a pair of opposed, parallel, spaced apart clothes supporting rods extending between and secured to the upper extremities of said longer arms in said uppermost "X"-shaped subassemblies;

(d) means for releasably locking said lazy tong linkages in their extended positions; and (e) a mesh support member extending between said two opposed, parallel, spaced apart clothes supporting rods at the upper extremities of said longer arms in said uppermost "X"-shaped subassembly, with means at opposite ends of said mesh support member for attaching the same to said two spaced apart clothes supporting rods.

2. The clothes drying rack of claim 1 in which the openings in said mesh support member are about 1" in width, and about 1" in length.

3. The clothes drying rack of claim 1 in which the openings in said mesh support member are about ½" in width, and about ½" in length.

4. The clothes drying rack of claim 1 in which the openings in said mesh support member are about ⅛" in width, and about ¼" in length.

5. The clothes drying rack of claim 1 in which:

(a) each of said lazy tong subassembly arms defines a receiving hole at the point of attachment of one of said clothes supporting rods to said arm, (b) a rigid ferrule is seated within said receiving hole to form a tight fit with the arm in which said hole is located, (c) the end portion of said one clothes supporting rod is seated within said ferrule to form a tight fit therewith, and (d) a threaded member that tapers to a minimum dimension at its free end is screwed into the end portion of said clothes supporting rod that is seated within said rigid ferrule, whereby said threaded member can be screwed farther into said rod end portion whenever it becomes necessary because of wear in the end portion of said rod that is seated within said ferrule.

6. The clothes drying rack of claim 5 in which:

(a) a receiving hole is defined in each of said lazy tong subassembly arms at each point of pivotal attachment of two of said arms and one of said clothes supporting rods, said two receiving holes being aligned with each other, (b) a rigid ferrule is seated within and extends through said two aligned receiving holes, and (c) the end portion of said one clothes supporting rod is seated within and extends through said ferrule, to form a tight fit therewith.

7. The clothes drying rack of claim 6 in which a threaded member that tapers to a minimum dimension at its free end is screwed into the end portion of said clothes supporting rod that is seated within said rigid ferrule, whereby said threaded member can be screwed farther into said rod end portion whenever it becomes necessary because of wear in the end portion of said rod that is seated within said ferrule, as said rod is pivoted, with respect to one of said lazy tong subassem-bly arms to which it is connected, during opening and closing of said lazy tong subassembly when the clothes drying rack is used over a long period of time.

* * * * *